US005700334A

United States Patent [19]

Ishii et al.

[11] Patent Number: 5,700,334

[45] Date of Patent: Dec. 23, 1997

[54] COMPOSITION AND PROCESS FOR IMPARTING A BRIGHT BLUE COLOR TO ZINC/ALUMINUM ALLOY

[75] Inventors: Hitoshi Ishii; Takao Ogino, both of Kanagawa-Ken, Japan

[73] Assignee: Henkel Corporation, Plymouth Meeting, Pa.

[21] Appl. No.: 535,253

[22] PCT Filed: Apr. 8, 1994

[86] PCT No.: PCT/US94/03691

§ 371 Date: Nov. 28, 1995

§ 102(e) Date: Nov. 28, 1995

[87] PCT Pub. No.: WO94/25640

PCT Pub. Date: Nov. 10, 1994

[30] Foreign Application Priority Data

Apr. 28, 1993 [JP] Japan ..... 5-102824

[51] Int. Cl.[6] ..... C23C 22/44

[52] U.S. Cl. ..... 148/273; 148/275

[58] Field of Search ..... 148/273, 275

[56] References Cited

U.S. PATENT DOCUMENTS 3,703,418 11/1972 Iijima ..... 148/273

FOREIGN PATENT DOCUMENTS 61-253381 11/1986 Japan .

*Primary Examiner*—Sam Silverberg

*Attorney, Agent, or Firm*—Ernest G. Szoke; Wayne C. Jaeschke; Norvell E. Wisdom, Jr.

[57] ABSTRACT

The rapid, low-temperature formation of a bright blue surface on hot-dip zinc/aluminum alloy-plated steel sheet that contains 0.1 to 60 weight % aluminum in the alloy, or on other surfaces of similar chemical composition, using conventional surface-treatment equipment, is achieved by treating the surface with a treatment bath that has a pH of 3.5 to 6.0 and that contains molybdenum compound at 0.2 to 3.0 weight % as molybdenum and simple or complex fluoride at 0.1 to 2.0 weight % as fluorine.

17 Claims, No Drawings

COMPOSITION AND PROCESS FOR IMPARTING A BRIGHT BLUE COLOR TO ZINC/ALUMINUM ALLOY

TECHNICAL FIELD

The present invention relates to a treatment process for imparting a blue color to the surface of zinc aluminum alloys, particularly the hot-dip Zn/Al alloy-plated steel sheet that is widely used as a construction material and for household electrical appliances, without at the same time impairing the bright surface appearance (metallic luster or gloss) that is possessed by such plated steel sheet. (The invention will often be described below with respect to plated steel sheet, but it should be understood that most of this discussion applies equally well to any other surface with the same chemical nature.) More specifically, the present invention relates to a novel composition and process for imparting a bright or brilliant blue color to hot-dip Zn/Al alloy-plated steel sheet, wherein the treatment bath in said process is very stable and the process can be run in simple equipment using lower temperatures and shorter times than in prior methods.

BACKGROUND ART

Metal coloring methods generally consist of inorganic chemical methods, organic chemical methods, electrolytic methods, and painting. Among these, the inorganic chemical coloring methods are the most advantageous in terms of equipment, cost, and workability. However, while various inorganic chemical coloring methods have been devised for application to aluminum sheet, aluminum alloy sheet, and zinc-plated steel sheet, an inorganic chemical coloring process has yet to be established for application to hot-dip zinc/aluminum alloy-plated steel sheet.

In specific terms, the following methods are known for the inorganic chemical coloring of aluminum and aluminum alloy:

(1) The generation of a deep black color by treatment at 80° C. for 10 minutes with an aqueous solution of 10 to 20 g/L of ammonium molybdate and 5 to 15 g/L of ammonium chloride;

(2) The generation of a brilliant sudan color by treatment for 5 minutes at 50° C. to 70° C. with an aqueous solution of 8 g/L of zinc sulfate, 3.3 g/L of sodium molybdate, and 2 g/L of sodium fluoride; and (3) The formation of a protective film on the surface of aluminiferous material using a composition that contains hexavalent chromium, fluoride ion, and a compound selected from molybdic acid and its sodium, potassium, and ammonium salts (Japanese Patent Publication Number Sho 45-32922 [32,922/1970]).

Treatment methods (1) and (2) are described by Takakado Nakayama in *The Surface Treatment of Aluminum* [Aruminiumu no Hycomen Shod] (Nikkan Kogyo Shinbunsha, 1969).

Various coloring methods for zinc-plated steel sheet have also been examined, and, as for aluminum and aluminum alloy, the inorganic chemical coloring methods offer advantages in terms of equipment, cost, and workability and are therefore in wide use. With regard to the inorganic chemical coloring of zinc-plated steel sheet, for example, Japanese Patent Application Laid Open [Kokai] Number Sho 61-253381 [253,381/1986]) discloses (4) a method for blackening zinc-plated steel sheet using an aqueous solution that contains copper ion and nickel ion.

In addition, the prior art for the coloration of zinciferous-plated steel sheet primarily yields blacks and browns, and a blue color and particularly a bright blue with a metallic gloss have heretofore been unavailable.

The application of prior-art methods (1) to (4) as described above to hot-dip zinc/aluminum alloy-plated steel sheet will now be considered. In the case of treatment methods (1) and (2), their application to hot-dip zinc/aluminum alloy-plated steel sheet does not produce the colors obtained by their application to aluminum or aluminum alloy, and in fact almost no change in color is obtained in either case. Moreover, since these treatments are intended principally for application to moldings, they require lengthy treatment times of at least 5 minutes. Because the treatment bath used in treatment method (3) is essentially a chromate treatment bath, the precipitated coating consists of a chromate film whose principal component is chromium oxide and which is therefore yellowish. Moreover, when the pH is increased to 3.5 to 6 in this method, the reactivity is diminished, the chromate coating weight therefore declines, and coloration does not occur. While treatment method (4) does rapidly produce a matte black appearance, this black coating is weakly adhesive, and the execution of some type of post-treatment is required as a result in order to improve its adherence.

In short, it has been determined that the rapid generation of a bright blue appearance cannot be obtained through the application to hot-dip zinc/aluminum alloy-plated steel sheet of a prior coloring method intended for aluminum, aluminum alloy, or zinc-plated steel sheet.

Hot-dip zinc/aluminum alloy-plated steel sheet is widely used at present as a construction material and for household electrical appliances. Its surface has a white metallic luster. Although an elegant look is provided by the metallic luster, the appearance of this material is ultimately aesthetically unsatisfactory because it lacks a sense of calmness and quality. Accordingly, there is strong demand for the appearance of a surface-treatment technology for hot-dip zinc/aluminum alloy-plated steel sheet that will yield a bright blue color which does not clash with but rather is in harmony with its surroundings and which also combines an elegant look with a high metallic luster.

DISCLOSURE OF THE INVENTION

Problems to Be Solved by the Invention

Specifically, the present invention seeks to introduce a method for imparting a bright blue color to the surface of hot-dip zinc/aluminum alloy-plated steel sheet, wherein said method employs the inorganic chemical coloring approach and does not require large-scale equipment, accomplishes this blue coloring faster and at lower temperatures than in previous coloring methods, and does not impair the original metallic luster of hot-dip zinc/aluminum alloy-plated steel sheet.

SUMMARY OF THE INVENTION

The inventors proceeded with their investigations after concluding that an elucidation of the following two points would be critical to a resolution of the problems described above for the prior art:

1. the nature of the constituent components of a film having the desired blue color, and 2. the chemical reactivity between the components of the treatment bath and hot-dip zinc/aluminum alloy-plated steel sheet.

It was discovered, first, that molybdenum compounds are the optimal treatment bath components for inducing the formation of a blue film on hot-dip zinc/aluminum alloy-plated steel sheet and that achieving the desired colored film using other inorganic compounds is quite problematic.

It was also discovered that the treatment bath preferably contains a particular quantity of fluoride in order to remove the tough oxidation coating present on the surface of hot-dip zinc/aluminum alloy-plated steel sheet and in order to provide a rapid etch of the plating layer. Furthermore, as the result of investigations into the relationship between pH and the etching reactivity of fluorides, it was determined that these compounds are not active throughout the entire pH range and that only at pH 3.5 to 6 is the reaction rate optimal for the coloring treatment that is the objective of the invention. The inventors discovered that only under this condition is it normally possible to obtain a uniform etch that does not impair the metallic luster. The present invention was achieved based on these discoveries.

In specific terms, the process in accordance with the present invention for imparting a bright or brilliant blue color to zinc/aluminum alloy surfaces that contains 0.1 to 60 weight % of aluminum, particularly those of hot-dip zinc/aluminum alloy-plated steel sheet, characteristically comprises treatment of the surface with a treatment bath that has a pH of 3.5 to 6, that does not contain chromium, and that comprises, preferably consists essentially of, or still more preferably consists of water, a molybdenum compound content of 0.2 to 3.0 weight % calculated as molybdenum, and a fluoride content of 0.1 to 2.0 weight calculated as fluorine.

DESCRIPTION OF PREFERRED EMBODIMENTS

An aluminum content of 0.1 to 60 weight % is required in the zinc/aluminum alloy to which the process of the present invention is applied. The desired bright blue color is not obtained when the aluminum content does not fall within this given range. Thus, when the aluminum content is below 0.1 weight %, the color darkens and the luster is lost. When the aluminum content exceeds 60 weight %, the coloring reaction does not develop to a satisfactory degree and the color, as a result, remains almost unchanged.

The molybdenum compound content in the treatment bath is preferably 0.2 to 3.0 weight % as molybdenum and is obtained by the addition of soluble molybdenum compounds. The rate of the coloring reaction declines at below 0.2 weight %, while the use of more than 3.0 weight % is economically unattractive because the activity becomes saturated and no longer improves. The particularly preferred molybdenum content is 0.5 to 2.0 weight %. Operable soluble molybdenum compounds are molybdate salts, phosphomolybdic acid, molybdenum chloride, and the like.

The treatment bath preferably contains fluoride at 0.1 to 2.0 weight % as fluorine. The etching reaction rate declines and the coloring reaction rate therefore declines at below 0.1 weight %. The use of more than 2.0 weight % is economically unattractive due to the absence of additional effects at such levels. A more preferred fluoride content is 0.3 to 1.0 weight %. Operable fluoride sources are specifically exemplified by hydrofluoric acid, sodium fluoride, potassium fluoride, ammonium fluoride, sodium bifluoride, fluosilicic acid, sodium fluosilicate, ammonium fluosilicate, fluoboric acid, fluotitanic acid, and fluozirconic acid.

The pH of the treatment bath must be adjusted or regulated to 3.5 to 6. The etching reactivity of the fluorine in the fluoride etchant is too strong at a pH below 3.5. This has the adverse result of reducing the amount of colored coating that is deposited and thus prevents the appearance of the desired color. In contrast to this, the etching reactivity declines at a pH above 6, which leads to a sharp decline in the rate of the coloring reaction. The pH can be regulated through the use of an alkali such as sodium hydroxide, sodium carbonate, ammonia, ammonium bicarbonate, potassium hydroxide, and the like, or through the use of an acid such as sulfuric acid, nitric acid, phosphoric acid, and the like. The pH range of 3.8 to 4.5 is particularly preferred. The treatment bath used in the present invention does not require the addition of chromic acid, chromium compounds, etc., and instead all chromium compounds are preferably omitted.

The above-described treatment bath is preferably applied to hot-dip zinc/aluminum alloy-plated steel sheet by spraying or immersion at a treatment temperature of 30° C. to 70° C. for a treatment time of 1 to 10 seconds. The reactivity of the treatment bath is inadequate at treatment temperatures below 30° C., while treatment temperatures above 70° C. do not afford any further increase in reactivity and are therefore economically unattractive. The treatment temperature range of 45° C. to 60° C. is particularly preferred. Treatment times less than 1 second do not yield the desired coloration due to an inadequate reaction. The coloring reaction is saturated at treatment times in excess of 10 seconds, and such treatment times therefore do not yield any further change in color. Treatment times in the range of 2 to 5 seconds are particularly preferred.

When the hot-dip zinc/aluminum alloy-plated steel sheet is contaminated with adhering oil, dirt, etc., it is preferably subjected to a degreasing process, for example, an alkali or solvent degreasing process, prior to execution of treatment in accordance with the present invention. Moreover, washing with water and drying after film formation may be conducted in the present invention on an optional basis.

The effect of the present invention is in no way diminished by the execution—after film deposition in accordance with the present invention—of a post-treatment (such as a chromate treatment, etc.) for the purpose of enhancing the corrosion resistance of the hot-dip zinc/aluminum alloy-plated steel sheet.

The discussion will now turn to what is believed to be the reaction mechanism during treatment of hot-dip zinc/aluminum alloy-plated steel sheet by the treatment bath in accordance with the present invention, but these statements are not to be construed as limiting the invention. When zinc/aluminum alloy is treated with the treatment bath in accordance with the present invention, the subject alloy surface is first etched due to the activity of the fluorine in the fluoride present in the treatment bath. This etching reaction is extremely important since it determines the reaction rate of the colored film-forming reaction. The etching activity of the fluorine in the fluoride present in the treatment bath undergoes major variations as a function of treatment bath pH, and the optimal etching reactivity is maintained in the pH range of 3.5 to 6. With regard to the tough oxidation film spontaneously present on the surface of this type of plating layer, only in the optimal pH range is it efficiently dissolved and removed by the fluorine component and the coloring reaction thereby promoted. Moreover, the metallic luster characteristic of hot-dip zinc/aluminum alloy-plated steel sheet is not impaired because the etching reaction in the invention treatment proceeds uniformly against the subject plating layer.

In addition, the zinc ion and aluminum ion eluted by the etching reaction are believed to reprecipitate onto the surface of the plating layer as hydrated oxides. Accompanying the elution, i.e., the oxidation, of the aluminum and zinc in the plated steel sheet under consideration, the molybdenum compound dissolved in the treatment bath is reduced to a compound with a lower oxidation number and precipitates onto the surface of the plating.

Thus, treatment of hot-dip zinc/aluminum alloy-plated steel sheet by the treatment bath of the present invention is believed to cause the development of a bright blue color because a coating consisting of a composite of molybdenum oxide and hydrated oxides of zinc and aluminum is formed on the surface of the plating layer, and the plating layer retains its metallic luster.

Any chromium component added to the treatment bath of the present invention, e.g., chromic acid, chromium compounds, and the like, acts as an inhibitor of the etching reaction and thus, if present in any substantial amount, prevents satisfactory development of the etching reaction and thus renders precipitation of the colored film inadequate. Although the etching reaction can be accelerated in the presence of chromium compounds by dropping the pH below 3.5, chromate film precipitation reactions then are believed to proceed in preference to molybdenum oxide precipitation in this low pH region, and the yellow color of the chromate film is then produced rather than the blue caused by molybdenum oxide.

The invention can be further appreciated by consideration of the following examples.

EXAMPLES AND COMPARISON EXAMPLES

1. Test materials

Six types of hot-dip zinc/aluminum alloy-plated steel sheet (plating mass=120 g/m$^2$) were employed, and these were fabricated using zinc/aluminum alloy plating baths. Six aluminum contents in the plating layers were used: 0.05 weight %, 0.15 weight %, 5 weight %, 15 weight %, 55 weight %, and 70 weight %. The aluminum content in the plating film on the test sheet used in a particular example or comparison example is reported in the particular example (Examples 1 to 6) or comparison example (Comparison Examples 1 to 6).

2. The treatment process

The following treatment process steps were performed in each of the examples and comparison examples. The individual conditions concerning the coloring treatment itself are respectively reported in the examples and comparison examples:

(1) Degreasing (FINECLEANER™ L4460, alkaline degreaser from Nihon Parkerizing Company, Limited) at 43° C. for 120 seconds by spraying.

(2) Water wash (tap water) at ambient temperature for 30 seconds by spraying.

(3) Coloring treatment as described below; the pH was adjusted with sodium hydroxide or sulfuric acid.

(4) Water wash (tap water) at ambient temperature for 30 seconds by spraying.

(5) Drying at 100° C. for 120 seconds.

Example 1

The test sheet (aluminum content in plating layer=5 weight %) was sprayed for 1 second with a treatment bath (pH=4.0, temperature=50° C.) that contained ammonium molybdate at 2.0 weight % as molybdenum and ammonium bifluoride at 0.7 weight % as fluorine.

Example 2

The test sheet (aluminum content in plating layer=0.15 weight %) was immersed for 9 seconds in a treatment bath (pH=5.7, temperature=33° C.) that contained phosphomolybdic acid at 2.8 weight % as molybdenum, fluosilicic acid at 1.5 weight % as fluorine, and hydrofluoric acid at 0.3 weight as fluorine (total fluorine=1.8 weight %).

Example 3

The test sheet (aluminum content in plating layer=55%) was immersed for 3 seconds in a treatment bath (pH=3.6, temperature=67° C.) that contained sodium molybdate at 1.5 weight % as molybdenum and hydrofluoric acid at 0.5 weight % as fluorine.

Example 4

The test sheet (aluminum content in plating layer=0.15%) was sprayed for 5 seconds with a treatment bath (pH=4.0, temperature=60° C.) that contained phosphomolybdic acid at 0.3 weight % as molybdenum and sodium fluoride at 0.12 weight % as fluorine.

Example 5

The test sheet (aluminum content in plating layer=15%) was immersed for 3 seconds in a treatment bath (pH=4.0, temperature=50° C.) that contained ammonium molybdate at 1.0 weight % as molybdenum and fluosilicic acid at 0.5 weight % as fluorine.

Example 6

The test sheet (aluminum content in plating layer=5 weight %) was immersed for 2 seconds in a treatment bath (pH=4.2, temperature=60° C.) that contained ammonium molybdate at 1.0 weight % as molybdenum and ammonium fluoride at 0.7 weight % as fluorine.

Comparison Example 1

The test sheet (aluminum content in plating layer=70%) was immersed for 0.7 seconds in a treatment bath (pH=5.5, temperature=27° C.) that contained ammonium molybdate at 1.5 weight % as molybdenum and fluosilicic acid at 0.5 weight % as fluorine.

Comparison Example 2

The test sheet (aluminum content in plating layer=0.05%) was immersed for 10 seconds in a treatment bath (pH=3.3, temperature=70° C.) that contained phosphomolybdic acid at 1.0 weight % as molybdenum and hydrofluoric acid at 1.0 weight % as fluorine.

Comparison Example 3

The test sheet (aluminum content in plating layer=5%) was sprayed for 5 seconds with a treatment bath (pH=3.0, temperature=50° C.) that contained ammonium molybdate at 1.0 weight % as molybdenum and hydrofluoric acid at 0.5 weight % as fluorine.

Comparison Example 4

The test sheet (aluminum content in plating layer=5%) was immersed for 5 minutes in a treatment bath (temperature=60° C.) that contained 8 g/L of zinc sulfate, 3.3 g/L of sodium molybdate (0.15 weight % as molybdenum), and 2 g/L of sodium fluoride (0.09 weight % as fluorine). The treatment bath pH, which was not adjusted, was 6.2. This treatment corresponded to a treatment described in Takakado Nakayama, *The Surface Treatment of Aluminum* (Nikkan Kogyo Shinbun-sha, 1969) for imparting a brilliant sudan color to aluminum.

Comparison Example 5

The test sheet (aluminum content in plating layer=5%) was immersed for 2 seconds in a treatment bath (pH=3.0, temperature=30° C.) that contained 10 g/L of copper ions, 1.5 g/L of nickel ions, and 20 g/L potassium chlorate. This treatment corresponds to the treatment method described in Example 7 of Japanese Patent Application Laid Open Number Sho 61-253381.

Comparison Example 6

The test sheet (aluminum content in plating layer=15%) was immersed for 10 seconds in a treatment bath (temperature=50° C.) that contained 0.5 weight % of chromium trioxide, 0.3 weight % of fluoride as $HBF_4$, and sodium molybdate at 0.1 weight % as molybdenum. The treatment bath pH, which was not adjusted, was 1.75. This treatment corresponds to the treatment method described in Example 1 of Japanese Patent Publication Number Sho 45-32922.

Testing

The appearance of the test sheets processed in accordance with Examples 1 to 6 and Comparison Examples 1 to 6 was determined using the trichromatic specification symbols stipulated in JIS Z 8721. The gloss (60°) was measured prior to treatment (G1) and after treatment (G2), and these values were used to calculate the gloss change ratio (DG=G2/G1). The adherence of the color film was evaluated based on the nature of its delamination when peeled with cellophane tape. These measurement results are reported in Table 1.

As Table 1 makes clear, a hue (2.5 B to 5 PB) centered on blue with saturation≧3 was obtained by application of the coloring process in accordance with the present invention to the surface of steel sheet hot-dip plated with Zn/Al alloy that contained 0.1 to 60 weight % Al. Moreover, while coloration occurred to a lightness≦6, a gloss change ratio of at least 0.3 was maintained. In other words, these results confirmed that treatment according to the present invention can impart a blue color with retention of the metallic gloss.

TABLE 1

| Identification | TCSS Values | | Gloss Ratio | Delamination? |
|---|---|---|---|---|
| | Hue | L/S | Change | |
| Example 1 | 5 PB | 4/6 | 0.32 | No |
| Example 2 | 2.5 PB | 5/10 | 0.41 | No |
| Example 3 | 10 B | 6/3 | 0.46 | No |
| Example 4 | 2.5 B | 5/4 | 0.35 | No |
| Example 5 | 2.5 PB | 5/8 | 0.40 | No |
| Example 6 | 2.5 PB | 5/6 | 0.44 | No |
| Comparison Example 1 | 5 PB | 9/1 | 0.63 | No |
| Comparison Example 2 | 2.5 B | 9/2 | 0.21 | No |
| Comparison Example 3 | 5 P | 8/2 | 0.08 | No |
| Comparison Example 4 | 5 B | 8/1 | 0.13 | No |
| Comparison Example 5 | 5 R | 2/1 | 0.01 | Yes |
| Comparison Example 6 | 2.5 Y | 8/12 | 0.06 | No |

Notes for Table 1
"TCSS" = Trichromatic Specification Symbol; "L/S" = Lightness/Saturation In contrast to this, in Comparison Example 1, the coloring reaction did not develop to an adequate degree because the aluminum content in the plating layer exceeded 60 weight %. In Comparison Example 2, the hydrofluoric acid etching reaction was too strong because the bath pH was below 3.5 and the plating layer contained less than 0.1 weight % aluminum. This inhibited the precipitation of the color film and also caused a decline in the gloss. In Comparison Example 3, the fluorine etching reaction was again too strong because the bath pH was a low 3.0. This inhibited the precipitation of the color film and destroyed the metallic luster. In Comparison Example 4, the bath pH exceeded 6.0 and the bath contained soluble molybdenum compound at less than 0.2 weight % as molybdenum and fluoride at less than 0.1 weight % as fluorine. As a result, the reactivity was inadequate, and the desired color could not be obtained (as in Comparison Examples 1 and 2) despite a lengthy treatment time of 5 minutes. Comparison Example 5 was an example of the prior art for the blackening of zinciferous-plated materials. Thus, blackening was obtained in this case, but the luster was severely reduced. Moreover, a satisfactory adherence was also not obtained. In Comparison Example 6, the treatment bath contained chromic acid and had a low pH of 1.75. This resulted in the precipitation of a chromate film: Not only was a yellow color obtained, but the metallic luster was lost.

Benefits of the Invention

As discussed in the preceding, the process of the present invention for imparting a blue color to hot-dip zinc/aluminum alloy-plated steel sheet is a highly cost-effective inorganic chemical coloring process that is capable of providing high added-value in terms of design and aesthetics. In addition, the treatment bath in the invention process is more stable than prior treatment baths and treatment in accordance with the invention process can be run at lower temperatures and in less time than in prior processes.

The invention claim is:

1. A process for imparting a bright blue color to a zinc/aluminum alloy surface that contains 0.1 to 60 weight % aluminum by treatment of the surface with an aqueous liquid treatment composition that has a pH of 3.5 to 6, that does not contain chromium, and that contains a molybdenum compound content of 0.2 to 3.0 weight % calculated as molybdenum and a fluoride content of 0.1 to 2.0 weight % calculated as fluorine.

2. A process according to claim 1, wherein the pH of the aqueous treatment composition is from 3.8 to 4.5.

3. A process according to claim 2, wherein the molybdenum content of the aqueous treatment composition is from 0.5 to 2.0 weight %.

4. A process according to claim 1, wherein the molybdenum content of the aqueous treatment composition is from 0.5 to 2.0 weight %.

5. A process according to claim 4, wherein the fluoride content of the aqueous treatment composition is from 0.3 to 1.0 weight %.

6. A process according to claim 3, wherein the fluoride content of the aqueous treatment composition is from 0.3 to 1.0 weight %.

7. A process according to claim 2, wherein the fluoride content of the aqueous treatment composition is from 0.3 to 1.0 weight %.

8. A process according to claim 1, wherein the fluoride content of the aqueous treatment composition is from 0.3 to 1.0 weight %.

9. A process according to claim 8, wherein the time of treatment is from 1 to 10 seconds and the temperature of the treatment composition during treatment is from 30° to 70° C.

10. A process according to claim 7, wherein the time of treatment is from 2 to 5 seconds and the temperature of the treatment composition during treatment is from 45° to 60° C.

11. A process according to claim 6, wherein the time of treatment is from 2 to 5 seconds and the temperature of the treatment composition during treatment is from 45° to 60° C.

12. A process according to claim 5, wherein the time of treatment is from 2 to 5 seconds and the temperature of the treatment composition during treatment is from 45° to 60° C.

13. A process according to claim 4, wherein the time of treatment is from 1 to 10 seconds and the temperature of the treatment composition during treatment is from 30° to 70° C.

14. A process according to claim 3, wherein the time of treatment is from 2 to 5 seconds and the temperature of the treatment composition during treatment is from 45° to 60° C.

15. A process according to claim 2, wherein the time of treatment is from 1 to 10 seconds and the temperature of the treatment composition during treatment is from 30° to 70° C.

16. A process according to claim 1, wherein the time of treatment is from 1 to 10 seconds and the temperature of the treatment composition during treatment is from 30° to 70° C.

17. A process according to claim 1, wherein the surface treated is that of hot-dip zinc-aluminum alloy-plated steel sheet.

* * * * *